United States Patent [19]

Breneman

[11] Patent Number: 4,821,762

[45] Date of Patent: Apr. 18, 1989

[54] FREEZELESS WALL FAUCET HAVING REMOVABLE CARTRIDGE

[75] Inventor: Warren R. Breneman, Colorado Springs, Colo.

[73] Assignee: Woodford Industries, Inc., Colorado Springs, Colo.

[21] Appl. No.: 185,994

[22] Filed: Apr. 25, 1988

[51] Int. Cl.[4] ..... F16K 1/02

[52] U.S. Cl. ..... 137/218; 137/360; 137/454.2; 137/614.2

[58] Field of Search ..... 137/218, 360, 454.2, 137/454.5, 454.6, 614.2

[56] References Cited

U.S. PATENT DOCUMENTS

| | | | |
|---|---|---|---|
| 2,783,773 | 3/1957 | Rasch | 251/278 X |
| 3,424,189 | 1/1969 | Woodford | 137/218 |
| 3,929,150 | 12/1975 | Flinner | 137/218 |
| 3,943,963 | 3/1976 | Papacek | 137/360 X |
| 3,952,770 | 4/1976 | Botnick | 137/360 |
| 4,177,971 | 12/1979 | Landamore | 251/225 X |
| 4,209,033 | 6/1980 | Hirsch et al. | 137/360 X |

*Primary Examiner*—Gerald A. Michalsky

*Attorney, Agent, or Firm*—Zarley, McKee, Thomte, Voorhees & Sease

[57] ABSTRACT

The present invention includes an elongated housing having a bore extending therethrough with an inlet end at one end and an outlet nozzle at the other end. A removable cartridge is inserted within the bore and includes the valve assembly and the handle and operating rod for moving the valve assembly. The entire working valve assembly and operating rod can be removed as a unit for replacement of o-rings or other parts.

11 Claims, 4 Drawing Sheets

FREEZELESS WALL FAUCET HAVING REMOVABLE CARTRIDGE

BACKGROUND OF THE INVENTION

This invention relates to a freezeless wall faucet having a removable cartridge therein.

Freezeless wall faucets or hydrants have been known in the art. Generally, these devices include a cylindrical housing having an inlet end and a nozzle outlet. A valve is included within the housing and is connected by means of a rod to a manually operable handle outside the housing. Rotation of the handle ceases the valve to open and close. Freezeless faucets are mounted on the exterior of a building with the valve extending inwardly with respect to the building to point where the valve is protected from freezing by the interior warmth of the building. The handle and nozzle are located on the exterior of the building.

After extended use, various interior parts of the freezeless faucet often become worn and need replacement. With presently known devices the replacement of the interior parts of these hydrants is difficult and cumbersome. This is because many of the interior parts of the housing, such as the valve and the various parts for the valve, are at least partially integral with the interior of the housing and are difficult to remove. Thus, the replacement of o-rings or other seals is often difficult and cumbersome in present devices.

Therefore, a primary object of the present invention is the provision of an improved freezeless faucet or hydrant.

A further object of the present invention is the provision of an improved faucet having a removable cartridge that can be removed as a unit from the interior of the faucet housing.

A further object of the present invention is the provision of an improved faucet that incorporates a removable cartridge and a backflow preventor.

A further object of the present invention is the provision of an improved faucet that incorporates the use of a removable cartridge and a vacuum breaker.

A further object of the present invention is the provision of a faucet having a removable cartridge comprising the entire working valve assembly which can be completely withdrawn from the casing assembly for quick and easy replacement.

A further object of the present invention is the provision of an improved faucet which provides precise control of the water flow from complete shut off to full flow with less than one full turn of the operating handle.

A further object of the present invention is the provision of an improved freezeless faucet which incorporates replaceable rubber seals which can be replaced with standard o-rings purchaased from hardware or similar stores.

A further object of the present invention is the provision of a faucet which features easy turn with the handle engaging a solid stop in the full flow condition and also in the shut off condition.

SUMMARY OF THE INVENTION

The present invention comprises an outer faucet housing or casing having an elongated bore extending there through. The bore has an inner end adapted to be connected to a pressurized source of fluid and an outer end adapted to be positioned exterior of the wall to which it is mounted. The housing has an outlet nozzle in communication with the bore adjacent the outer end of the bore for permitting fluid to exit from the bore.

Within the bore of the housing is a removable valve cartridge which contains the entire working assembly of the faucet including the actuating handle, an elongated operating rod attached to the handle at one end thereof, a valve assembly carried on the opposite end of the rod, and a seal assembly mounted to the rod adjacent the handle. The valve cartridge is inserted within the bore of the housing so that the valve assembly is located adjacent the inner end of the bore and the seal assembly is mounted in sealing engagement with the walls of the bore adjacent the outer end of the bore. The handle is located outside the bore.

A set screw lock is provided in the housing for engaging the cartridge and holding the cartridge within the bore of the housing. The set screw can be removed so as to permit the cartridge to be removed as an integral unit from the bore of the housing.

The valve assembly is movable from a closed position preventing fluid flow from the inner end of the bore to the nozzle to an open position permitting fluid flow from the inner end of the bore through the bore to the nozzle and outwardly through the nozzle. The valve assembly is movable between its open and closed position in response to rotation of the handle and rod between an on position and an off position.

A vacuum breaker is mounted to the housing and is located between the sealing assembly of the cartridge and the valve assembly of the cartridge. The vacuum breaker provides a vent to the bore at all times except when water is flowing through the bore from the inlet end of the bore outwardly through the housing. This prevents a back siphoning of any fluid through the faucet.

A back flow preventor is also provided within the housing and is adapted to prevent any reverse flow of fluid within the housing regardless of whether or not that reversed flow results from back siphoning or from other causes of reverse flow within the housing. The back flow preventor is movable to an open position in response to exposure of pressurized fluid from the inlet end of the housing so that fluid is permitted to flow through the bore from the inner end thereof to the nozzle.

The handle is rotatably mounted within the seal assembly and is adapted to move axially in unison with the rod in response to rotation therewith so as to cause the valve to move between its open and close positions. A stop is provided on the exterior of the housing for engaging the handle so that the handle engages the stop both in the open and closed positions. This is accomplished by virtue of the fact that the valve moves from its fully opened position to its fully closed position in response to slightly less than 360 degree rotation.

In order to replace the o-rings within the valve assembly of the cartridge, it is merely necessary to remove the lock screw and slide the entire cartridge out of the bore of the housing. The valve rings can then be replaced by conventional rubber seals found in hardware or similar stores. The cartridge can then be replaced and the lock screw again inserted to hold the cartridge in place within the housing. It is also possible to replace the entire cartridge in the event it becomes damaged or worn through extended use.

DETAILED DESCRIPTION OF THE PREFERRED EMBODIMENT

Figure 2:
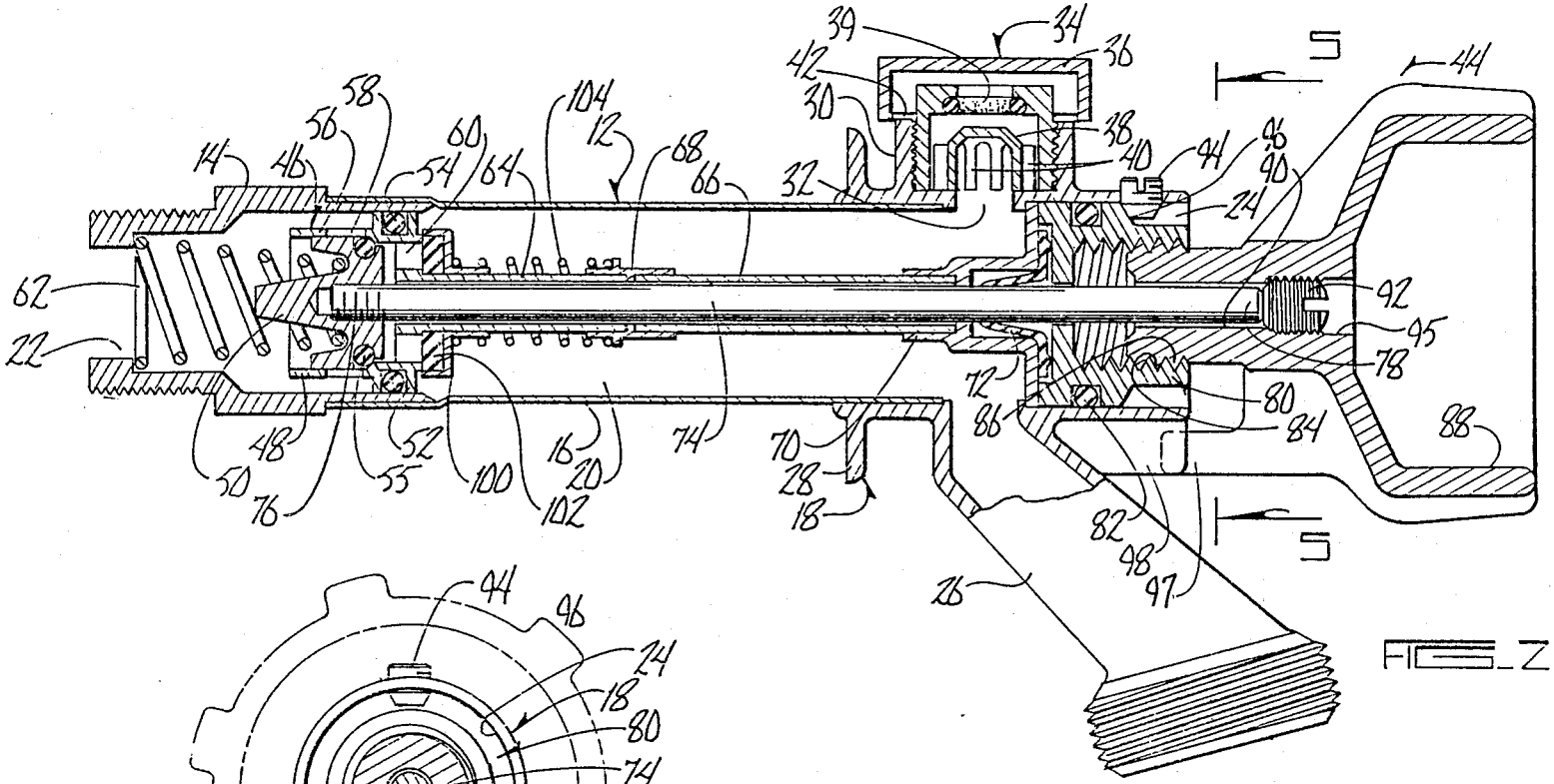
FIG. 2 is a sectional view taken along line 2—2 of FIG. 1 showing the valve in its closed position.
Figure 1:
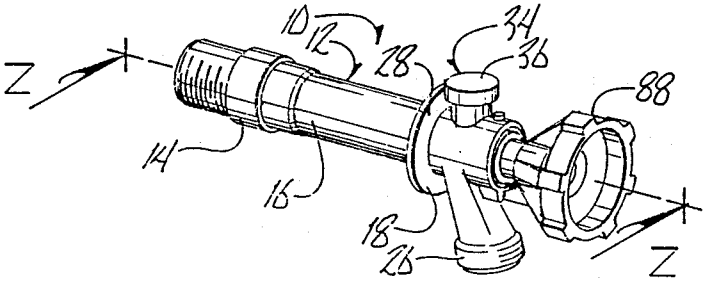
FIG. 1 is a perspective view of the faucet of the present invention.

Referring to the drawings, the numeral 10 generally designates the faucet of the present invention. Faucet 10 includes an outer faucet housing 12 which includes an inner brass connector 14, a central tubular barrel 16 and an outer casting member 18 which are connected to one another so as to form an elongated bore 20 having an inner end 22 and an outer end 24. Casting 18 includes an outlet nozzle 26 which is in communication with bore 20 so as to permit fluid to exit therefrom. Casting 18 is also provided with an annular flange 28 which is adapted to fit in facing engagement against the wall of the building on which the faucet is mounted. Extending upwardly from casting 18 is a vacuum breaker receptacle 30 which is threaded internally and which is in communication with bore 20 through a vent opening 32.

Threaded within receptacle 30 is a vacuum breaker 34 comprising a vacuum breaker cap 36, a vacuum breaker float valve 38 and a vacuum breaker seal 39. When the float 38 is in the position shown in FIG. 2, it permits venting of the bore 20 to the atmosphere. The venting occurs as air is free to pass upwardly from barrel 20 through vent opening 32, around the spaced apart fingers 40 of float 38, through the center of o-ring 39 and outwardly from beneath cap 36 through openings 42. However, when fluid pressure is introduced into barrel 20, it forces float 38 to move upwardly into engagement with o-ring 40 as shown in FIG. 3. This closes off the communication between the atmosphere and bore 20. Thus, water is free to flow through bore 20 and outwardly through nozzle 26 when the float is in the condition shown in FIG. 3. However, when the bore 20 is not subjected to fluid pressure, the float 38 drops again to its position shown in FIG. 2 and prevents any back siphoning from occurring in bore 20.

Figure 4:
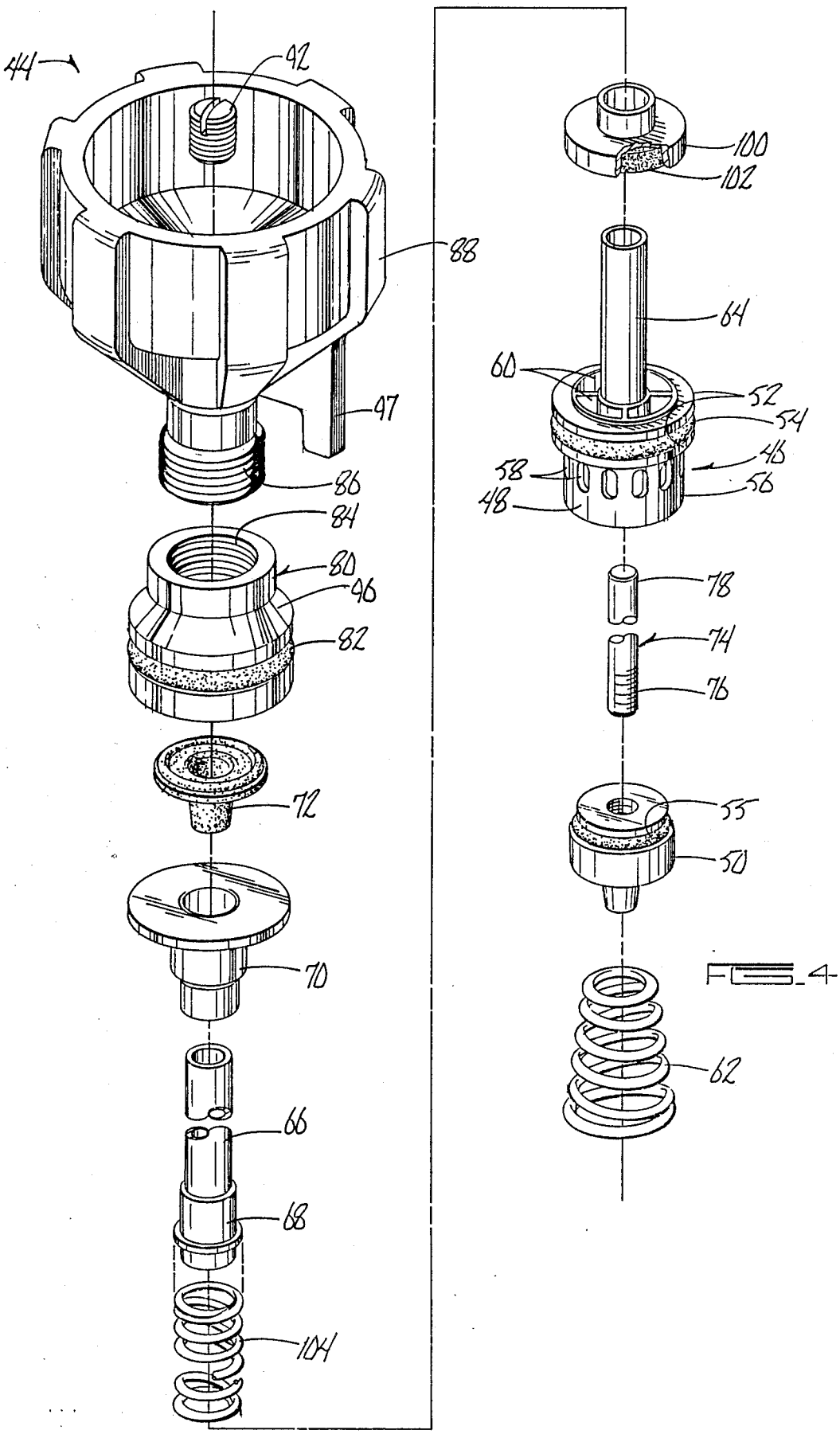
FIG. 4 is an exploded perspective view of the cartridge assembly of the present invention.

Removably fitted within bore 20 is a cartridge assembly generally designated by the numeral 44. Cartridge assembly 44 is shown in an exploded view in FIG. 4. At the extreme inner end of cartridge 44 is a valve assembly 46 comprising a valve casing 48 and a movable valve body 50. Surrounding valve casing 46 are a pair of annular spaced apart flanges 52 in which a valve casing o-ring 54 is seated. O-ring 54 sealing engages the interior walls of brass connector 14 so as to prevent fluid from passing around valve assembly 46.

Figure 3:
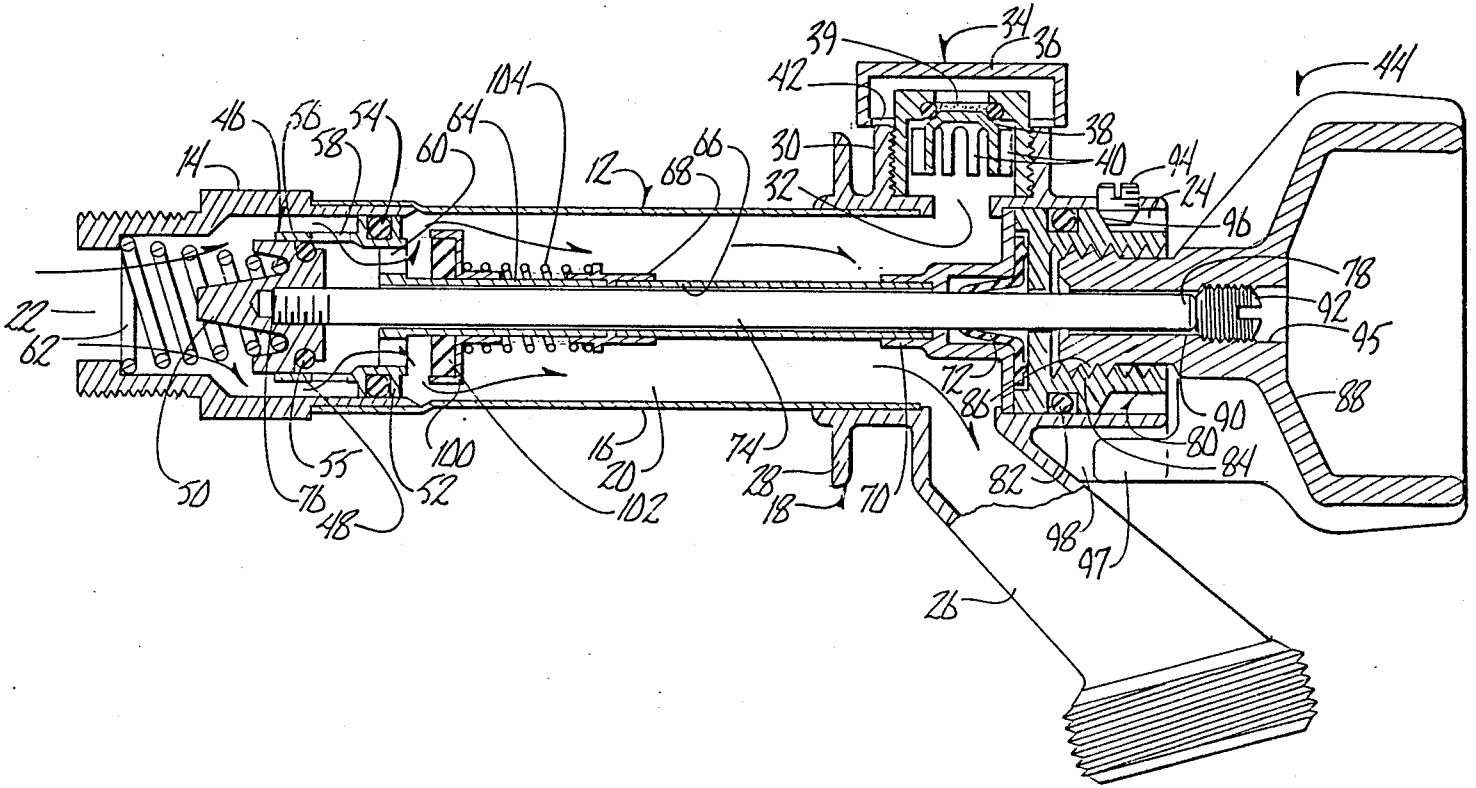
FIG. 3 is a view similar to FIG. 2, but showing the valve in its open position.

Valve casing 48 also includes a forwardly presented collar 56 in which valve body 50 is slidably fitted for movement between a closed position, such as shown in FIG. 2, to an open position, such as shown in FIG. 3. Valve body 50 includes an o-ring seal 55 which sealingly engages the interior cylindrical wall of collar 56. Collar 56 includes a plurality of inlet openings 58 around its circumference. When valve body 50 is in its closed position, such as shown in FIG. 2, these inlet openings are closed off so that fluid cannot enter the interior of collar 56 through openings 58. However, when the valve body 50 is in the position shown in FIG. 3 the inlet openings 58 are opened and fluid is free to enter the interior of valve casing 48 through inlet openings 58 and pass through valve casing 48 and outwardly through an outlet opening 60. A spring 62 yieldably urges valve body 50 toward its closed position as shown in FIG. 2.

Attached to the forward end of valve casing 48 is a thin wall copper tube section 64 which is connected to a second tube section 66 by means of a tube coupling 68. Valve casing 48 along with collar 56 and tube 64 form an integral one piece unit. Tube 64 is threaded to connect with tube coupling 68.

Attached to the forward end of tube section 66 is a rod seal support 70 having an operating rod seal 72 therein. Slidably fitted within rod seal support 70, and tube sections 64, 66 is an operating rod 74 which has an inner end 76 rotatably fitted within a centrally located bore within valve body 50, and an outer end 78 protruding outwardly through rod seal support 70 and through outer end 24 of bore 20.

Fitted within the outer end 24 of bore 20 and abutting against rod seal support 70 is a handle nut 80 which sealing engages the inner wall of bore 20 by means of an o-ring seal 82. Handle nut 80 includes a threaded counter bore 84 which threadably receives a threaded shank 86 of a handle 88. Handle 88 has a central bore 90 extending there through which receives the outer end 79 of rod 74. A threaded adjusting screw 92 is threaded within a counter bore 95 and handle 88 and engages the outer end 78 of rod 74 so as to limit outward movement thereof. Screw 92 may be rotated to provide minor adjustment of the axial position of rod 74.

Handle nut 80 is retentively held within the outer end 24 of bore 20 by means of a set screw 94 which threadedly extends through housing 12 and which engages an angled shoulder 96 on handle nut 80.

The valve assembly 46 may be opened and closed by rotating handle 88. In the position shown in FIG. 2, the handle 88 is displaced axially to the right within the threaded bore 84 of handle nut 80, and this permits the rod end 76 to be retracted forwardly in response to pressure from spring 62. This holds the valve body 50 in its closed position. Rotation of handle 88 so as to cause handle 88 to move from the position shown in FIG. 2 to the position shown in FIG. 3 results in axial movement of handle 88 to the left and consequently, causes axial movement of rod 74 to the left, thereby moving valve body 50 to its open position and permitting fluid to pass through valve assembly 46.

Figure 5:
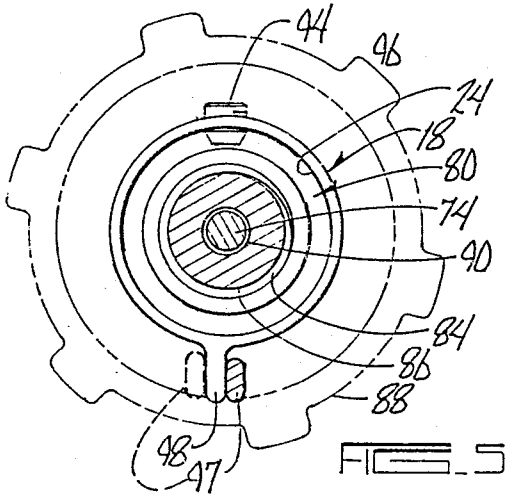
FIG. 5 is a sectional view taken along line 5—5 of FIG. 2.

Handle 88 includes a finger 97 thereon which engages a stop flange 98 on the housing 12. As can be seen in FIG. 5, finger 97 can rotate approximately 360 degrees from the position shown in solid lines in FIG. 5 to the position shown in phantom lines in FIG. 5.

A backflow preventor 100 is slidably mounted over the outside of tube section 64 and includes a sealing washer 102 adapted to fit in sealing engagement around the perimeter of valve outlet opening 60. Backflow preventor 100 is yieldably urged into facing engagement with the perimeter of outlet opening 60 by means of a backflow spring 104. When the valve assembly 48 is closed as shown in FIG. 2, the spring 104 urges the backflow preventor 100 into sealing engagement around the outlet opening 60 so as to prevent any backflow of fluid backwardly through the valve toward the inlet opening 22. Thus, any back pressure from a hose or other device attached to nozzle 26 will not result in contamination of the source of water to which the faucet is connected. When the valve is turned to its open position, as shown in FIG. 3, the pressure of the water within valve casing 58 causes the movement of the backflow preventor 100 to the right as shown in FIG. 3 so as to permit fluid to enter bore 20 and flow outwardly through nozzle 26. When the valve is shut off the backflow preventor again returns to the position shown in FIG. 2 by virtue of the action of spring 104.

In the event that a repair to the cartridge is needed, the cartridge can be removed easily by the removal of set screw 94. Removal of the set screw 94 permits the handle nut 80 and the handle 88 to be removed outwardly from the housing 12. Similarly, rod 74 and tube sections 64, 66, as well as valve assembly 46 can be removed so as to replace various parts or seals that are necessary. The seals 54, 55, and 82 are conventional o-ring seals and can be easily replaced by seals commonly found in hardware stores or other commercial outlets. The fact that the entire cartridge and working assembly can be completely withdrawn from the casing assembly for quick and easy replacement of parts provides a significant advantage over devices known in the prior art. The present faucet also provides precise control of the water flow from complete shut off to full flow in less than one full turn of the operating handle. Rubber seal replacement, if necessary, can be accomplished with standard o-rings purchased from hardware or similar stores. The faucet also includes an easy turning handle which engages a solid stop in the full flow condition and also in the shut off position.

Figure 6:
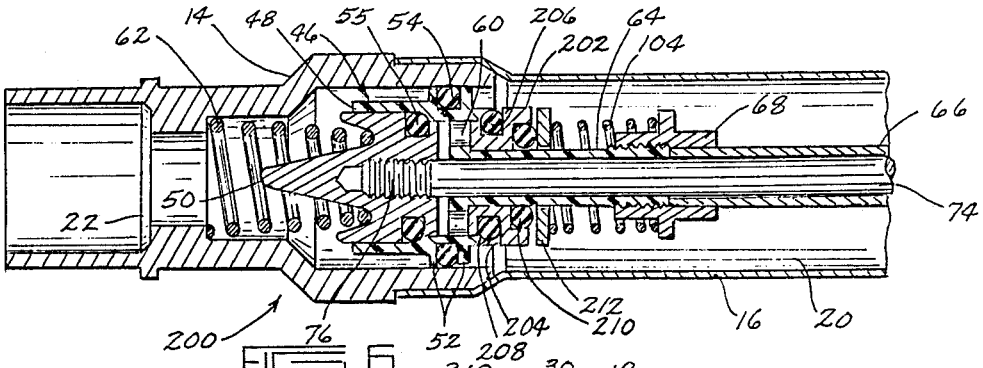
FIG. 6 is a sectional detail showing a modified form of the backflow preventor.

Referring to FIG. 6, a modified form of the backflow preventor is shown and is designated generally by the numeral 200. Many of the parts of backflow preventor 200 are identical to those parts shown in FIGS. 2 and 3, and corresponding numerals are used to indicate identical parts. Backflow preventor 200 includes a movable member 202 which surrounds copper tube section 64 and which is slidable both to the left and the right as viewed in FIG. 6. Member 202 includes an annular channel 204 in which is seated a circular o-ring 206. O-ring 206 is adapted to seal against 45 degree chamfer 208 in the manner previously described for sealing washer 102 in the backflow preventor shown in FIG. 3. Backflow preventor 200 also includes a second o-ring 210 which provides a seal between movable member 202 and the other surface of copper tube section 64. A washer 212 is fitted between spring 104 and second o-ring 210 so as to hold o-ring 210 in place. The device functions much in the same manner as the backflow preventor 100 shown in FIG. 3, but the sealing provided by o-rings 206 and 210 coupled with the 45 degree chamfer 208 and the washer 212, provide a more positive seal preventing fluid from passing from outlet opening 60 whenever the member 202 is in its closed position.

Figure 7:
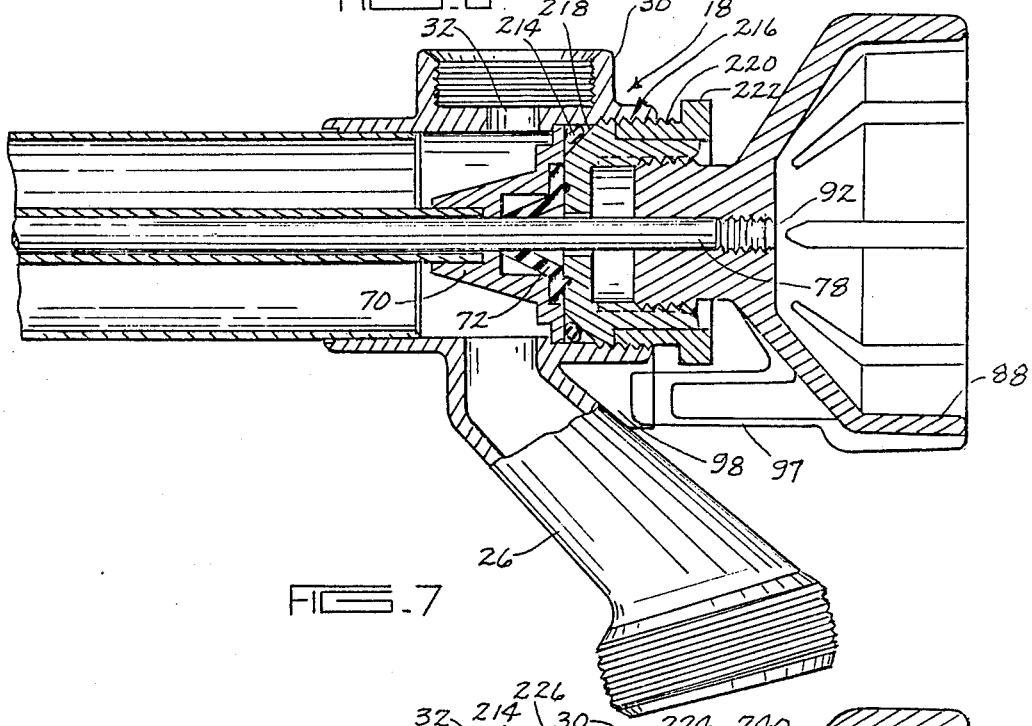
FIG. 7 is a sectional detail showing a modified form of handle assembly.

Referring to FIG. 7, a modified form of the handle assembly is shown. Many of the parts are identical to the parts shown in FIG. 3 and corresponding numerals are utilized to indicate identical parts. Seated within casting member 18 and abutting against rod support 70 is an annular o-ring 214. A sealing member 216 having a chamfered surface 18 is fitted within casting member 18 with chamfered surface 218 pressing against sealing ring 214 so as to compress sealing ring 214 and provide a tight seal within casting member 18. A head lock nut 220 is threadably fitted within casting member 218 and holds sealing member 216 in tight engagement against rod support 70 and o-ring 214. Head lock nut 220 includes conventional flats 222 so as to permit it to be tightened or loosened as desired. Handle 88 is threaded within sealing member 216 so that rotation of handle 88 causes handle 88 to move to the left and right as viewed in FIG. 7. This causes rod 78 to move axially.

Figure 8:
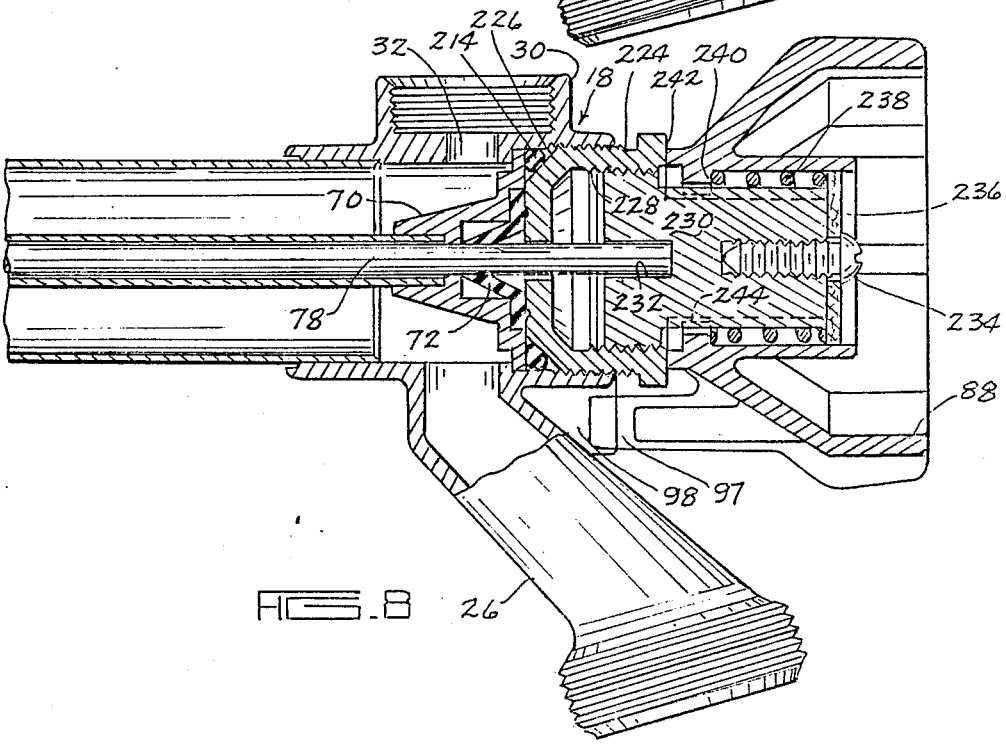
FIG. 8 is a sectional detail showing another modified form of handle assembly.

Referring to FIG. 8, another modified form of the handle assembly is shown. Threaded within casting member 18 is a threaded head nut 224 which includes an inner chamfered corner 226 which presses against annular o-ring 214. Threaded head nut 224 includes an inner cylindrical surface 228 which is threaded and which threadedly receives a sliding block 230. Block 230 includes a cavity 232 for receiving the outer end 78 of rod 74. A retaining washer 236 is attached to the forward end of sliding block 230 by means of a screw 234. Handle 88 is held in place by means of a spring 238 which is compressed between retaining washer 236 and an inner flange 240 on handle 88. The spring 238 presses handle 88 against a rubbing surface 242 on head nut 224. The result of this arrangement is that the handle 88 is not likely to rotate in response to excessive water line pressure. However, handle 88 is adapted to rotate sliding block 230 whenever handle 88 is rotated by virtue of mating splined surfaces 244 between handle 88 and sliding block 230. Thus, rotation of handle 88 causes similar rotation of sliding block 230, and the threaded engagement of block 230 within head nut 224 causes the block 230 to move axially, sliding along the mating splined surfaces 244. This arrangement prevents possible rotation of the handle and subsequent shut-off of the water in response to excessive water line pressure. Thus, it can be seen that the device accomplishes at least all of its stated objectives.

What is claimed is:

1. A freezeless wall faucet comprising:

an elongated faucet housing having an elongated bore extending therethrough, said bore having an inner end adapted to be connected to a pressurized source of fluid and an outer end, said housing having an outlet nozzle in communication with said bore adjacent said outer end of said bore for permitting fluid to exit from said bore;

a valve cartridge removably inserted within said bore and comprising sealing means, valve means, an elongated tube assembly having a tube bore extending therethrough and having an outer cylindrical surface, said tube assembly having a first end connected to said sealing means and a second end connected to said valve means, a handle connected to said sealing means, an elongated operating rod extending through said tube bore and being longitudinally movable therein, said rod having a first rod end engaging said handle and a second rod end engaging said valve means;

said cartridge being removable from an inserted position within said bore wherein said sealing means sealingly engages the wall of said bore adjacent said outer end thereof and said valve means is positioned within said bore adjacent said inner end thereof to a removed position wherein said entire cartridge is removed from said bore through said outer end thereof;

locking means on said housing and movable from a locked position wherein said locking means engages said cartridge to prevent removal of said cartridge from said inserted to said removed positions to an unlocked position wherein said locking means permits removal of said cartridge from said inserted to said removed positions;

said nozzle being between said valve means and said sealing means when said cartridge is in said inserted position;

said valve means comprising valve sealing means sealingly engaging said wall of said bore when said cartridge is in said inserted position;

said valve means being movable from a closed position preventing fluid flow from said inner end of said bore to said nozzle to an open position permitting fluid flow from said inner end of said bore through said bore to said nozzle and outwardly through said nozzle;

said handle being movable from an off position to an on position for causing longitudinal movement of said rod within said tube assembly so as to cause movement of said valve means from said closed position to said open position;

backflow preventor means movably mounted on said outer cylindrical surface of said tube assembly adjacent said valve means for longitudinal sliding movement to said tube assembly between a forward flow position wherein fluid is free to pass from said valve means to said nozzle to a backflow position wherein said backflow preventor means blocks the reverse flow of fluid from said nozzle through said valve means to said inner end of said bore, spring means yieldably holding said backflow preventor means in said backflow position and being yieldable to permit movement of said backflow preventor means to said forward flow position in response to fluid flow from said inner end of said bore through said valve means toward said nozzle;

said backflow preventor means being carried by said cartridge when said cartridge is moved from said inserted to said removed position.

2. A faucet according to claim 1 comprising vacuum breaker means mounted on said housing and being in communication with said bore between said valve means and said sealing means when said cartridge is in said inserted position, said vacuum breaker means being movable from a low pressure position providing communication through said vacuum breaker means between said bore and the atmosphere to high pressure position closing off communication through said vacuum breaker means between said bore and the atmosphere, said vacuum breaker means being in said low pressure position whenever fluid pressure within said bore is equal to or less than atmospheric pressure and being responsive to increased fluid pressure within said bore above atmospheric pressure to move from said low pressure position to said high pressure position.

3. A faucet according to claim 1 wherein said locking means comprises a single set screw threadably extending through said housing and retentively engaging said cartridge when said locking means is in said locked position.

4. A faucet according to claim 1 where said sealing means comprises a handle nut, said handle threadably engaging said handle nut and being rotatable relative to said handle nut for causing longitudinal movement of said handle and said rod relative to said handle nut so as to move from said on to said off positions.

5. A faucet according to claim 4 wherein said handle moves completely from said on position to said off position in response to rotation of said handle less than one 360 degree revolution relative to said handle nut.

6. A faucet according to claim 1 wherein said valve means comprises a valve housing, and a valve body movably mounted within said valve housing for movement toward said inner end of said bore when said valve means moves to said open position and for movement toward said outer end of said bore when said valve means moves from said open to said closed position a valve spring yieldably urging said valve body toward said outer end of said bore, said rod engaging said valve member and being responsive to movement of said handle said off position and said on position to cause movement of said valve body toward said inner end of said bore against the bias of said valve spring.

7. A faucet according to claim 6 wherein said handle and said rod are axially movable toward said inner end of said bore when moving from said off position to said on position and are axially movable toward said outer end of said bore when moving from said on position to said off position.

8. A faucet according to claim 7 wherein said handle threadably engages said sealing means and is rotatable with respect to said sealing means during movement between said off position and said on position so as to cause axial movement of said rod and said handle with said bore.

9. A faucet according to claim 6 wherein a valve housing seal surrounds said valve housing and sealingly engages said wall of said bore so as to prevent passage of fluid through said bore around the outside of said valve means, said valve housing having a valve inlet opening for receiving fluid from said inner end of said bore and having a valve outlet opening permitting fluid to pass from said valve inlet opening through said valve housing and said valve outlet opening toward said nozzle, said valve body blocking passage of fluid through said valve housing when said valve means is in said closed position and permitting fluid to pass through said valve housing when said valve means is in said open position.

10. A faucet according to claim 1 wherein said valve means comprises a valve housing and a valve body movably mounted within said valve housing for movement between said open position and said closed position, said valve housing having a valve inlet opening and a valve outlet opening, said valve outlet opening facing outwardly toward said outer end of said bore, said backflow preventor means being in sealing covering engagement over said outlet whenever said backflow preventor means is in said backflow position.

11. A faucet according to claim 10 wherein said backflow preventor means comprises a slide member mounted over said tube assembly for axial sliding movement thereon between said backflow position and said forward flow position, backflow seal means being provided on said slide member for sealingly engaging said valve outlet opening when said backflow preventor means is in said backflow position.

* * * * *